US005203485A

United States Patent [19]

Cahill et al.

[11] Patent Number: 5,203,485

[45] Date of Patent: Apr. 20, 1993

[54] PNEUMATIC WEB FEEDING

[75] Inventors: Michael J. Cahill; Kevin R. Fincham, both of Coventry, England

[73] Assignee: Molins PLC

[21] Appl. No.: 418,526

[22] Filed: Oct. 10, 1989

[30] Foreign Application Priority Data

Oct. 11, 1988 [GB] United Kingdom ..... 8823815

[51] Int. Cl.[5] ..... B65H 20/14

[52] U.S. Cl. ..... 226/97; 34/156; 406/88

[58] Field of Search ..... 226/97, 196, 7; 406/88, 406/86, 94; 34/156, 110

[56] References Cited

U.S. PATENT DOCUMENTS

| | | | |
|---|---|---|---|
| 1,595,478 | 8/1926 | Minton | 226/97 X |
| 3,472,436 | 10/1969 | Jura | 226/97 X |
| 4,053,967 | 10/1977 | Mair | 226/97 X |
| 4,074,841 | 2/1978 | Kramer et al. | 226/97 |
| 4,288,015 | 9/1981 | Curtin | 226/97 |
| 4,290,210 | 9/1981 | Johansson | 226/97 X |
| 4,308,984 | 1/1982 | Vits | 226/7 X |
| 4,718,178 | 1/1988 | Whipple | 226/97 X |
| 4,836,429 | 6/1989 | Nakashima et al. | 226/97 X |
| 4,913,049 | 4/1990 | Sainio | 226/7 X |
| 4,913,329 | 4/1990 | Cahill et al. | 226/196 X |

FOREIGN PATENT DOCUMENTS

| | | |
|---|---|---|
| 2109674 | 10/1980 | United Kingdom . |
| 2201665 | 11/1981 | United Kingdom . |

*Primary Examiner*—Katherine Matecki
*Assistant Examiner*—Paul T. Bowen
*Attorney, Agent, or Firm*—Antonelli, Terry, Stout & Kraus

[57] ABSTRACT

An air mover (14) for producing a stream of air along a guide surface (28,30) for conveying web or other sheet material along a path adjacent the surface is constructed in two parts (16,18) having mating surfaces (23,24) one of which includes a recess (22) which defines a slot (26) through which conveying and entraining air is delivered to the guide surface from an air pressure chamber (20) within the air mover.

19 Claims, 4 Drawing Sheets

PNEUMATIC WEB FEEDING

Figure 1:
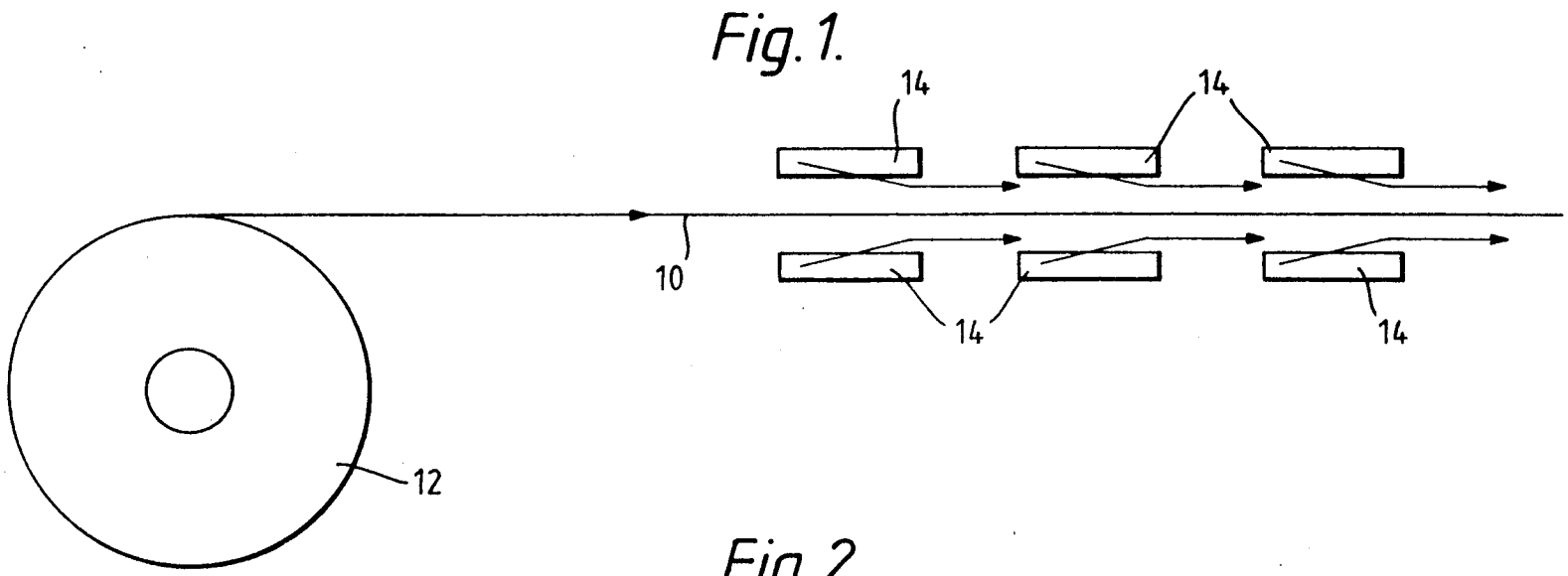

This invention relates to feeding web or sheet material pneumatically.

British patent specifications Nos. 2109764 and 2201665 relate to feeding cigarette paper web pneumatically. The present invention is particularly, but not exclusively, applicable to feeding similar web material, particularly in a cigarette making machine.

According to one aspect of the invention there is provided an air mover for producing a stream of air along a guide surface for conveying web or other sheet material along a path adjacent the guide surface, comprising a body having first and second parts, and means for conveying pressurized air, said guide surface including adjacent first faces of said parts, each of said parts having a second face which adjoins said first face, said second faces having complementary portions which are sealingly in engagement, at least one of said second faces having a recess which defines the other of said faces a slot, said slot extending from said pressure air conveying means to said guide surface.

The first and second faces of at least one of said parts may be substantially flat. The first and second faces of said at least one part may be angularly disposed relative to one another or may be substantially coplanar. The first faces of said first and second parts may be substantially flat and coplanar, or may include portions which are angularly disposed relative to one another. In the latter case the first faces may be substantially flat and define an angular transition in the region of said slot, and/or one of said first faces may include an arcuate portion.

The air pressure conveying means preferably includes a chamber in said body. The chamber may be defined by adjoining surfaces of the first and second parts.

The first and second parts may respectively have further first faces defining a further guide surface and further second faces defining with said further first faces a further slot, said further slot extending from said further guide surface to said air pressure conveying means. The guode surface and said further guide surface may be angularly disposed relative to one another. Thus the air mover may, in effect, be a composite member incorporating two slots from which air is exhausted from a common chamber.

An air mover according to the invention may be disposed adjacent an arcuate guide path for a web, the guide surface of said body including a portion shaped so as at least partly to conform with the shape of the arcuate guide path. Thus, where the arcuate guide path in defined, for example, by a roller around which the web passes, the guide surface may have a curvature corresponding with that of the roller.

A plurality of air movers may be arranged in series so that the respective guide surfaces define a common path for a run of a web and such that each air mover may impart cumulative tension to the run of a web on said path. Preferably at least one air mover is provided on each side of the path, so that opposite sides of the run of a web on the path are adjacent an air stream.

According to another aspect of the invention a method of producing a tension in a web of material conveyed along a guide path includes producing air streams having a cumulative tensioning effect on the web by means of a plurality of air movers arranged in series along the path. The air movers may be provided to generate air streams on opposite sides of a web on the path.

Figure 2:
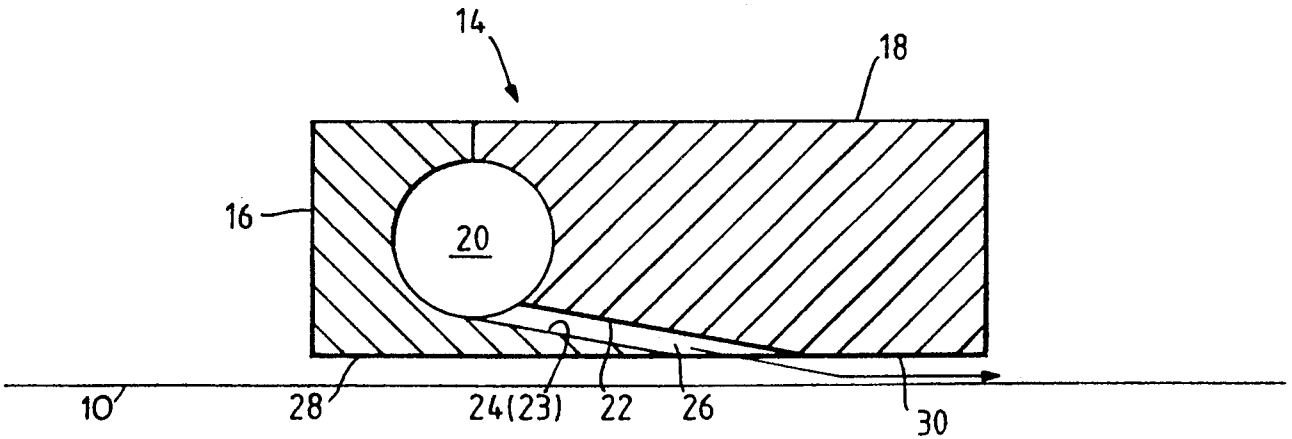
Figure 3:
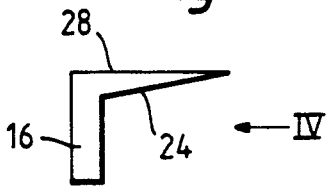
Figure 4:
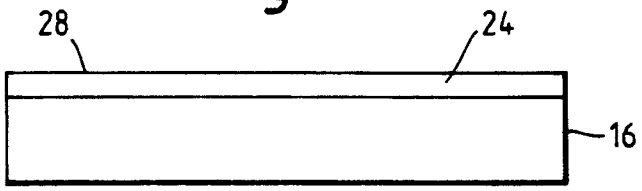
Figure 5:
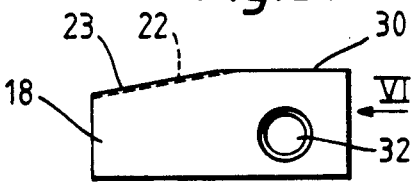
Figure 6:
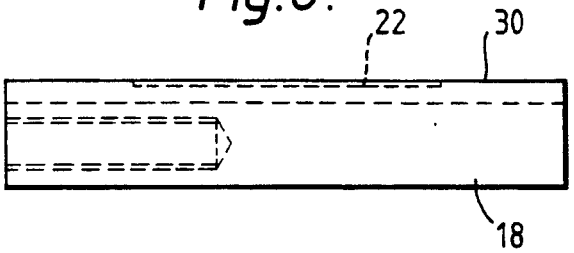
Figure 7:
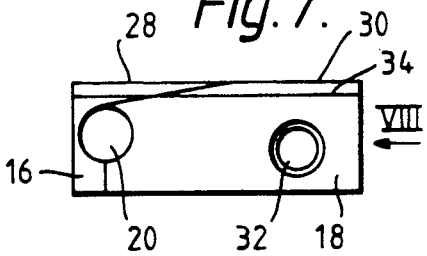
Figure 8:
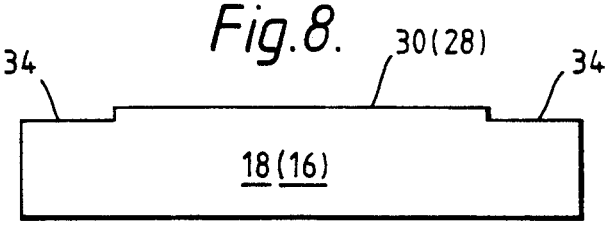
Figure 9:
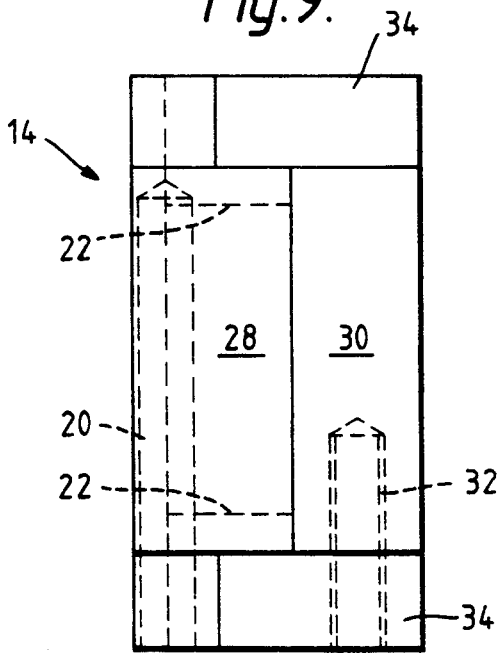
Figure 10:
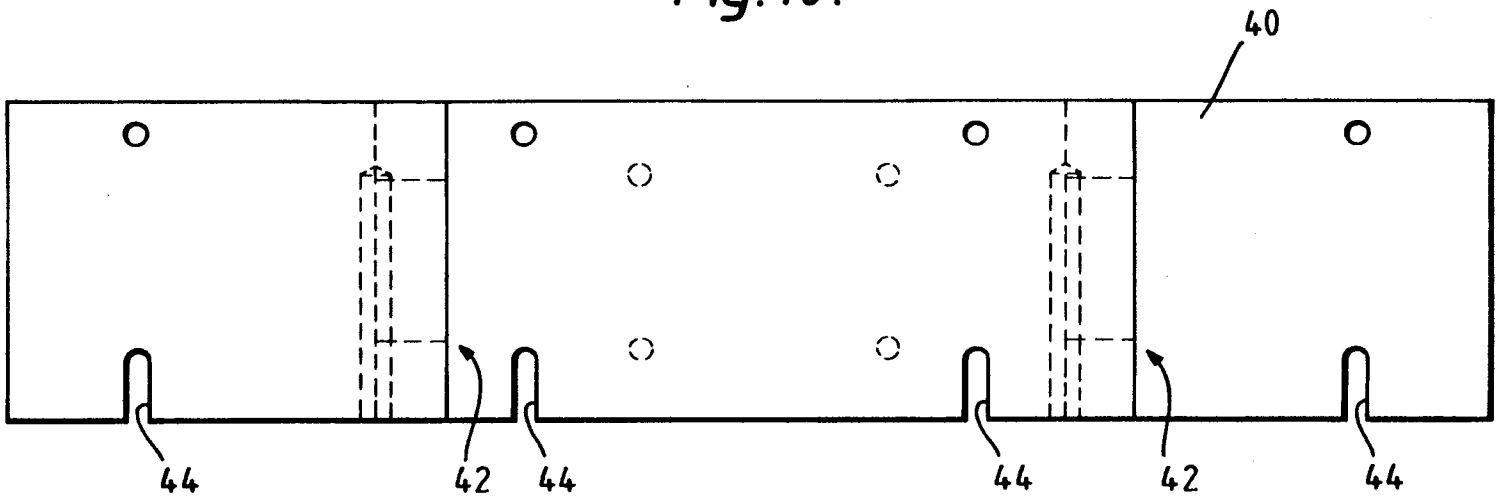
Figure 11:
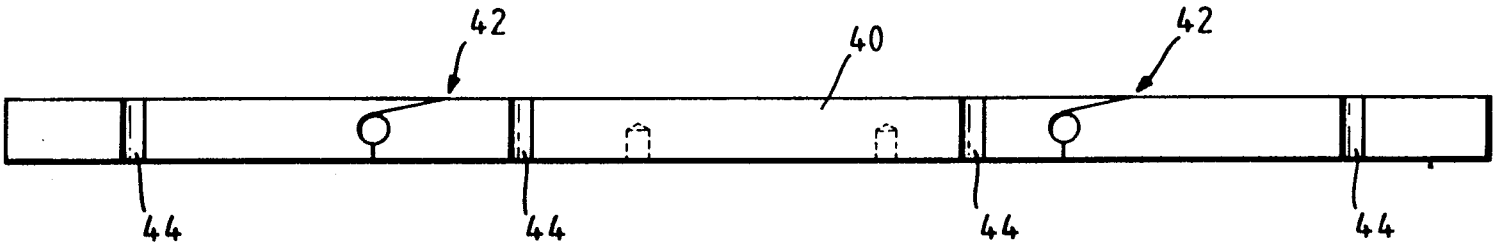
Figure 12:
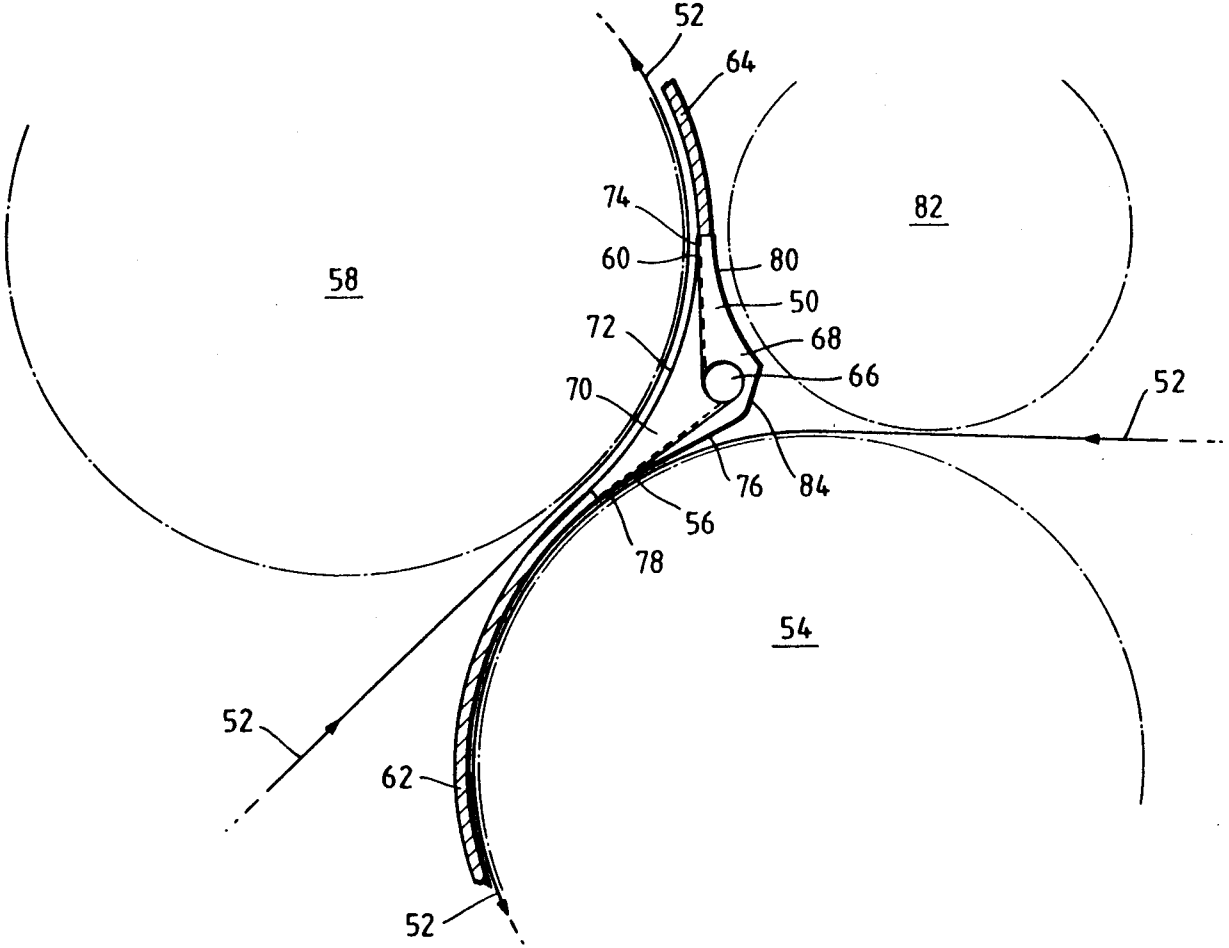

The invention will be further described, by way of example only, with reference to the accompanying diagramatic drawings, in which:

FIG. 1 is a side view of a web conveying system incorporating a plurality of air movers, FIG. 2 is an enlarged sectional side view of an air mover, FIG. 3 is a side view of a part forming an air mover, FIG. 4 is a view in a direction of arrow IV in FIG. 3, FIG. 5 is a side view of another part for forming an air mover, FIG. 6 is a side view in the direction of arrow IV in FIG. 5, FIG. 7 is a side view of an air mover incorporating the parts of FIGS. 3 and 5, FIG. 8 is a view in the direction of arrow VIII in FIG. 7, FIG. 9 is a plan view of the air mover of FIG. 7, FIG. 10 is a plan view of a guide incorporating air movers in series, FIG. 11 is a side view of the guide of FIG. 10, and FIG. 12 is a side view of a web conveying system which includes a composite air mover.

FIG. 1 shows a web 10 being drawn from a reel 12 with the aid of three pairs of air movers 14 ganged together so that their effect on the web is cumulative.

As shown in FIG. 2, each air mover 14 comprises first and second mating parts 16,18, between which is defined an air pressure chamber 20. The part 18 has a recess 22 in an inclined face 23, the recess extending for part only of the width (i.e. in the direction normal to the plane of the drawing) of the inclined face, so as to define with a similar inclined face 24 of the part 16 a slot 26 which extends from the chamber 20 to the junction between coplanar faces 28,30 respectively of the parts 16,18.

Air exhausting through the slot 26 forms a relatively high velocity stream which tends to follow the face 30, as indicated by the arrow, due to Coanda effect, and to entrain relatively large quantities of ambient air. The combined result is that a substantial conveying force may be applied to a web adjacent the faces 28,30 by reason of the moving air stream.

As shown by FIG. 1, air movers 14 can be disposed opposite each other, acting on opposite sides of the web 10, and in series.

FIGS. 3–9 show the construction of an air mover 14 in more detail. FIGS. 3 and 4 show the part 16. The angle between the faces 24 and 28 is 10°. FIGS. 5 and 6 show the part 18 and the extent of the recess 22 in the inclined face 23. The part 18 also includes a threaded bore 32 by use of which the air mover 14 may be mounted on a support structure (not shown). FIGS. 7, 8 and 9 show the completed air mover 14. The parts 16 and 18, which are typically of machined brass or aluminium, are assembled together using a suitable adhesive (e.g. Loctite 495). The bore forming chamber 20 is drilled and reamed with the parts 16,18 clamped together and any burrs which may be formed removed before the parts are finally assembled. Shoulder recesses 34 are formed in the faces 28,30: this to allow mounting of the air mover with faces 28,30 extending in an aperture in an appropriate guide plate having a thickness corresponding to the depth of the recesses 34 (i.e. so that the faces 28,30 will be flush with the surface of the guide plate).

Typical dimensions of the air mover 14 as shown in FIGS. 3–9 are:

| | |
|---|---|
| Overall length | 43 mm |
| Overall width | 22 mm |
| Overall depth | 8 mm |
| Diameter of bores 20,32 | 4 mm |
| Depth of recess 22 | 0.2 mm |
| Width of recess 22 | 23 mm |
| Depth of recess forming shoulders 34 | 0.9 mm |

FIGS. 10 and 11 show a composite guide plate 40 including two air movers 42 in series. Construction and operation of the air movers 42 are similar to those of the air mover 14. Slots 44 are provided for adjustably mounting the guide plate 40 relative to a web path. One or several plates 40 could be positioned on each side of a web path to provide a web tensioning arrangement similar to that shown in the system of FIG. 1. Composite guide plates containing more than two air movers may be provided.

FIG. 12 shows a different form of composite air mover 50, in which a cigarette paper web 52 is required to traverse a tortuous path through printing apparatus in a cigarette making machine. The apparatus includes a first drag roller 54 around which the web 52 passes with the aid of an air stream issuing from a first slot 56 of the air mover 50. Subsequently, after passing around at least one further roller (not shown) the web 52 returns to pass around a second drag roller 58 with the aid of an air stream issuing from a second slot 60 of the air mover 50. Guide plates 62,64 are respectively positioned for guiding the web around the rollers 54,58 downstream of the air mover 50. The slots 56,60 communicate with a common pressure chamber 66.

The construction of the air mover 50 is substantially analogous to that of the air mover 14 but there are two guide surfaces for the two web paths and these surfaces are shaped or angled to correspond with the arcuate path of the web 52. Thus, the air mover 50 has two parts 68,70 and the part 70 has an arcuate guide surface 72 having a radius corresponding to that of the roller 58, which surface 72 tapers towards a flat surface 74 of the part 68. The slot 60 is formed by a recess in the surface 74. The construction in the region of the roller 54 is slightly different, the part 68 having a flat surface 76 inclined at 10° to a flat surface 78 of the part 70. The slot 56 is formed by a recess in the surface 78. The part 68 has a further curved surface 80, which allows positioning of the air mover 50 without interference with a pinch roller 82 which may cooperate with the first drag roller 54. Finally, the part 50 is truncated at 84.

Operation of the air mover 50 is wholly analogous with that of the air movers previously described, the leading and subsequent parts of the paper web 52 being threaded and conveyed along the desired path by assistance of the air stream issuing from the air mover. The apparatus may include further air movers (not shown) for guiding and conveying the web 52 along other portions of its desired path through the apparatus.

We claim:

1. An article conveyance device in the form of an air mover for producing a stream of air moving along a guide surface for the purpose of conveying web or other sheet material longitudinally along a path which follows the guide surface, comprising a body having first and second parts, and having means for conveying pressurized air; adjacent first faces of said first and second parts comprising said guide surface, each of said parts having a second face which adjoins said first face, said second faces having complementary portions which are sealingly in engagement with each other, at least one of said second faces having a recess which defines with the other of said second faces a slot, said slot extending from said pressurized air conveying means to said guide surface, so that pressurized air is supplied via said slot to said guide surface for applying pressure to move a web or other sheet material longitudinally along a path which follows said guide surface.

2. An air mover as claimed in claim 1, wherein said first and second faces of at least one of said parts are substantially flat.

3. An air mover as claimed in claim 2, wherein said first and second faces of said at least one part are angularly disposed relative to one another.

4. An air mover as claimed in claim 2, wherein said first and second faces of said at least one part are substantially coplanar.

5. An air mover as claimed in claim 1, wherein said first faces of said first and second parts are substantially flat and coplanar.

6. An air mover as claimed in claim 1, wherein said first faces of said first and second parts include portions which are angularly disposed relative to one another.

7. An air mover as claimed in claim 6, wherein said first faces are substantially flat and define an angular transition in the region of said slot.

8. An air mover as claimed in claim 6, wherein one of said first faces includes an arcuate portion.

9. An air mover as claimed in claim 1, wherein said pressurized air conveying means includes a chamber in said body.

10. An air as claimed in claim 9, wherein said chamber is defined by adjoining surfaces of said first and second parts.

11. An air mover as claimed in claim 1, wherein said first and second parts respectively have further first faces defining a further guide surface and further second faces defining with said further first faces a further slot, said further slot extending from said further guide surface to said air pressure conveying means.

12. An air mover as claimed in claim 11, wherein said guide surface and said further guide surface are angularly disposed relative to one another.

13. An air mover as claimed in claim 1, and means defining an arcuate guide path for a web adjacent said guide surface, said guide surface including a portion shaped so as at least partly to conform with the shape of said arcuate guide path defining means.

14. An air mover as claimed in claim 13, wherein said portion of said guide surface has a curvature corresponding with that defined by said guide path defining means.

15. Apparatus including a plurality of air movers as claimed in claim 1, said air movers being arranged in series so that the respective guide surfaces define a common path for a run of a web and such that each air mover may impart cumulative tension to the run of a web on said path.

16. Apparatus as claimed in claim 15, including at least one air mover on each side of said path, so that opposite sides of the run of a web on said path are adjacent an air stream.

17. An article conveyance apparatus having a plurality of air movers for producing a stream of air moving along a guide surface for the purpose of conveying web or other sheet material longitudinally along a path which follows the guide surfaces, each of said air movers comprising a body having first and second parts, and having means for conveying pressurized air; adjacent first faces of said first and second parts comprising said guide surface, each of said parts having a second face which adjoins said first face, said second faces having complementary portions which are sealingly in engagement with each other, at least one of said second faces having a recess which defines with the other of said second faces a slot, said slot extending from said pressurized air conveying means to said guide surface, so that pressurized air is supplied via said slot to said guide surface for applying pressure to move a web or other sheet material longitudinally along a path which follows said guide surface.

18. An article conveyance apparatus according to claim 17, wherein air movers are provided to generate air streams on opposite sides of a web on said guide path.

19. An article conveyance apparatus according to claim 17, wherein air movers are provided in substantially opposed positions relative to said guide path for purposes of tensioning a web on said guide path and causing said web to be conveyed by said air streams.

* * * * *